US007375733B2

(12) United States Patent
Ando

(10) Patent No.: US 7,375,733 B2
(45) Date of Patent: May 20, 2008

(54) METHOD FOR DRIVING IMAGE DISPLAY APPARATUS

(75) Inventor: Muneki Ando, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 655 days.

(21) Appl. No.: 11/039,802

(22) Filed: Jan. 24, 2005

(65) Prior Publication Data

US 2005/0179707 A1 Aug. 18, 2005

(30) Foreign Application Priority Data

Jan. 28, 2004 (JP) ..... 2004-019679
Jan. 28, 2004 (JP) ..... 2004-019680

(51) Int. Cl.
*G09G 5/10* (2006.01)

(52) U.S. Cl. ..... 345/690; 345/77; 345/89

(58) Field of Classification Search ..... 345/87–100, 345/204, 691, 77, 78, 690
See application file for complete search history.

(56) References Cited

U.S. PATENT DOCUMENTS 5,699,078 A * 12/1997 Yamazaki et al. ..... 345/89
5,874,933 A * 2/1999 Hirai et al. ..... 345/89
6,445,367 B1 9/2002 Suzuki et al. ..... 345/75.2
2004/0125046 A1 7/2004 Yamazaki et al. ..... 345/1.3
2005/0156869 A1 7/2005 Mori et al. ..... 345/104

FOREIGN PATENT DOCUMENTS

JP 8-234690 9/1996
JP 9-251276 9/1997
JP 2004-133138 4/2004

* cited by examiner

*Primary Examiner*—Regina Liang
(74) *Attorney, Agent, or Firm*—Fitzpatrick, Cella, Harper & Scinto

(57) ABSTRACT

An image display apparatus includes: a first driving mode that selects only one scanning wiring in one selection period; and a second driving mode that drives the image display apparatus so as to select, in one selection period, a plurality of scanning wiring at the same time and to select, in the following selection period, a plurality of scanning wiring shifted by one scanning wiring from the plurality of scanning wiring selected in the preceding selection period, and uses, in the first driving mode, a correction display signal computed in the first driving mode and for correcting variation in luminance, and outputs, in the second driving mode, a modulation signal based on a correction display signal different from the correction display signal computed in the first driving mode.

4 Claims, 12 Drawing Sheets

○ SELECTION (EMIT LIGHT)

◍ SEMI-SELECTION (NOT EMIT LIGHT)

● NON-SELECTION (NOT EMIT LIGHT)

METHOD FOR DRIVING IMAGE DISPLAY APPARATUS

BACKGROUND OF THE INVENTION

1. Field of the Invention

The present invention relates to a method for driving an image display apparatus for forming an image on a plane.

2. Description of the Related Art

In an image display apparatus of a fixed pixel structure, there are cases where the uniformity of luminance is degraded by variation in luminous efficiency of each pixel or the like. In order to cope with this problem, for example, as disclosed in Japanese Patent Application Laid-Open (JP-A) No. 8-234690 and JP-A No. 9-251276, a technology for improving the uniformity of luminance by correcting the amount of drive for each pixel has been known.

FIG. 1 shows a configuration of a conventional image display apparatus. A reference numeral 1 denotes a display panel using a surface conduction electron-emitting device. Scanning wiring Dx1 to Dxm in the direction of row and modulation wiring Dy1 to Dyn in the direction of column are arranged in a matrix and electron-emitting devices (not shown) are arranged at respective points of intersection, so that the display panel 1 is provided with the electron-emitting devices arranged in a matrix with m rows and n columns.

When current is passed through this device, electrons are emitted and the device has a non-linear characteristic as shown in FIG. 2. For example, when a voltage of 16 V is applied to the device, electrons are emitted, but when a voltage of 8 V is applied, electrons are hardly emitted. Further, the emitted electrons are accelerated by acceleration means (not shown) and collide with a phosphor surface (not shown) to emit light. That is, the device emits light when it has a voltage of 16 V applied thereto but does not emit light even when it has a voltage of 8 V, one-half the voltage, applied thereto. Hence, passive matrix drive shown in FIG. 3 can be performed.

A reference numeral 2 in FIG. 1 denotes a scanning driving unit. The scanning driving unit 2 is constructed of a selector switch 22, a selection potential generating unit 23, and a non-selection potential generating unit 24.

A reference numeral 3 denotes a modulation driving unit. The modulation driving unit 3 is further constructed of a shift register 31, a latch 32, a pulse width modulating circuit 33, and a driving amplifier 34.

A reference numeral 4 denotes a synchronization separating unit and a reference numeral 5 denotes an AD converter. The synchronization separating unit 4 and the AD converter 5 are provided if necessary. A reference numeral 6 denotes a control circuit for generating a drive control signal. A reference numeral 7 denotes an image processing unit for converting resolution. A reference numeral 8 denotes a multiplier for correcting display data by correction data. A reference numeral 11 denotes a correction memory for storing the correction data.

A reference symbol S1 denotes an analog image signal input to an apparatus. A reference symbol S2 denotes a synchronous signal separated from the analog image signal S1. A reference symbol S3 denotes is a digital image signal obtained by sampling the analog image signal S1 by the AD converter 5. A reference symbol S4 denotes a display signal obtained by subjecting the digital image signal to image processing. A reference symbol S5 is a conversion timing signal supplied to the AD converter 5. A reference symbol S6 denotes an image processing control signal for controlling the action of the image processing unit 7. A reference symbol S7 denotes an image clock signal for controlling the action of the shift register 31. A reference symbol S8 denotes a modulation control signal for controlling the action of the modulation driving unit 3. A reference symbol S9 denotes a PWM clock that becomes the action reference of a pulse width modulating circuit 33. A reference symbol S10 denotes a scanning control signal for controlling the action of the scanning driving unit 2. A reference symbol S11 denotes a corrected correction display signal. A reference symbol S13 denotes a correction memory control signal for controlling a data output timing from the correction memory 11. S15 denotes a correction signal read from the correction memory 11.

The synchronous signal S2 extracted from the analog image signal S1 input to the apparatus by the synchronization separating unit 4 is input to the control circuit 6.

The control circuit 6 generates various kinds of drive control signals S5 to S10, and S13 from the synchronous signal S2.

The AD converter 5 inputs the analog image signal S1 according to the conversion timing signal S5 and samples the analog image signal S1 and outputs the digital image signal S3.

The image processing unit 7 inputs the digital image signal S3 and performs image processing such as image adjustment and resolution conversion and outputs the display signal S4.

The correction memory 11 outputs the correction signal S15 according to the correction memory control signal S13. The multiplier 8 inputs the display signal S4 and the correction signal S15 and multiplies the display signal S4 by the correction signal S15 and outputs the correction display signal S11.

An action for the scanning driving unit 2 and the modulation driving unit 3 to drive the display panel 1 will be described. Timing at this time is shown in FIG. 4.

In the modulation driving unit 3, the correction display signal S11 is input to the shift register 31 in sequence in synchronization with the image clock signal S7 and display data is held in the latch 32 according to the LOAD signal of the modulation control signal S8. Then, a pulse signal having a length responsive to the data held in the latch 32 is generated by the pulse width modulation circuit 33 by use of the STRAT signal of the modulation control signal S8 with reference to the PWM clock S9 and has its voltage amplified to Vm by the driving amplifier 34 and drives the modulation wiring of the display panel 1.

In the correction memory 11 is stored correction data corresponding to the respective pixels of the display panel 1.

It is assumed that the display signal S4 corresponding to each device constructing each pixel of the display panel 1 is D(x, y) (where $1 \leqq x \leqq n$ and $1 \leqq y \leqq m$, ditto for the following), and that the total sum of electric power applied to each light-emitting device in one frame based on the display signal S4 or the correction display signal S11 is the amount of driving V(x, y), and that the amount of light emission of each device is P(x, y), and the relative luminous efficiency of each device (Individual luminous efficiency normalized by the average of the luminous efficiencies of all devices. An average device is 1, and an inefficient device, namely, a dark device is 1 or less) is K(x, y).

Since the amount of light emission of the display device is proportional to the amount of driving applied to the display device, the following equation holds:

$$P(x, y) \propto V(x, y) \quad \text{[Equation 1]}$$

When a correction is not made, variation in the luminous efficiency of the device affects an image to be displayed and hence an image of $$P(x, y) \propto D(x, y) \times K(x, y) \quad \text{[Equation 2]}$$

is formed on the display panel 1. This makes the image look rough and spotted.

Here, the inverse of luminous efficiency K(x, y) of each device is made a correction coefficient Q(x, y), which is stored in the correction memory 11. The correction coefficient Q(x, y) is a correction value for correcting the variation in the luminance of each device and is determined for each device. When the multiplier 8 multiplies the D(x, y) of the display signal S4 by the Q(x, y) of the correction signal S15 as a correction value and D(x, y)×Q(x, y) as a correction display signal S11 drives the display panel 1, under the influence of luminous efficiency of the device, an image of $$P(x, y) \propto D(x, y) \times Q(x, y) \times K(x, y) \quad \text{[Equation 3]}$$

is formed on the display panel 1. Since Q(x, y) is the inverse of K(x, y), the image of P(x, y)∝D(x, y), in which variation in the luminous efficiency of each device is cancelled, is formed, in other words, a uniform image can be generated.

SUMMARY OF THE INVENTION

There is a tendency to prefer a bright screen generally in image display apparatuses, in particular, in consumer products. However, in the consumer products, at the same time, a demand for cost is also always severely made and hence cost reduction is a problem always required to be solved. On the other hand, the quality of a display image, in particular, the uniform luminance of pixels is an important element as an indicator of performance of the image display apparatus.

In view of the above circumstances, the object of the present invention is to provide an image display apparatus having a bright screen and high image quality.

In order to achieve the above object, the present invention adopts the following configurations.

According to one aspect of the present invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on a display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein the modulation signal is output in the first driving mode by use of a first correction coefficient corresponding to each display device and for correcting variation in luminance, and the modulation signal is output in the second driving mode by use of a second correction coefficient different from the first correction coefficient in the first scanning mode.

According to another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein the modulation signal is output in the first driving mode by use of a first correction coefficient corresponding to each display device, and the modulation signal is output in the second driving mode based on a correction display signal computed newly every time according to the display signal and the first correction coefficient in the first driving mode so as to compensate for an error of luminance caused in the second driving mode.

According to still another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein the modulation signal is output in the first driving mode by use of a first correction coefficient corresponding to each display device, and the modulation signal is output in the second driving mode based on a correction display signal computed by use of an average value of the first correction coefficients corresponding to display devices driven by a same modulation signal in selecting and driving a plurality of scanning wiring at the same time.

According to still another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein a first correction coefficient corresponding to the first driving mode and a second correction coefficient corresponding to the second driving mode are stored in a memory in advance, and the modulation signal is output based on a correction display signal computed by use of either of the first correction coefficient or the second correction coefficient according to each driving mode.

According to still another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising a process for selecting and driving a plurality of scanning wiring at the same time, by which the image display apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period; and wherein a first correction coefficient corresponding to each display device in a driving method for selecting the scanning wiring one by one without using the process for selecting and driving a plurality of scanning wiring at the same time is stored in a memory in advance; and the modulation signal is output based on a correction display signal computed newly every time according to the display signal and the first correction coefficient so as to compensate for an error of luminance caused by using the process for selecting and driving a plurality of scanning wiring at the same time.

According to still another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising a process for selecting and driving a plurality of scanning wiring at the same time, by which the image display apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period; and wherein a first correction coefficient corresponding to each display device in a driving method for selecting the scanning wiring one by one without using the method for selecting and driving a plurality of scanning wiring at the same time is stored in a memory in advance; and the modulation signal is output based on a correction display signal computed by use of an average value of the first correction coefficients corresponding to the display devices driven by a same modulation signal in the process for selecting and driving a plurality of scanning wiring at the same time.

According to still another aspect of the invention, there is provided a method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising a process for selecting and driving a plurality of scanning wiring at the same time, by which the image display apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period; and wherein a second correction coefficient constructed of an average value of first correction coefficients corresponding to display devices driven by a same modulation signal in the process for selecting and driving a plurality of scanning wiring at the same time based on the first correction coefficients corresponding to the display devices in a driving method for selecting the scanning wiring one by one without using the process for selecting and driving a plurality of scanning wiring at the same time is stored in a memory in advance; and the modulation signal is output based on a correction display signal corrected by use of the second correction coefficient.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on a display signal to the modulation wiring in parallel in synchronization with the selection signal to drive the display device, the apparatus comprising:

a first driving mode that selects only one scanning wiring in one selection period;

a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period; and a control circuit that controls the image display apparatus so as to output, in the first driving mode, the modulation signal by use of a first correction coefficient corresponding to each display device and for correcting variation in luminance and so as to output, in the second driving mode, the modulation signal by use of a second correction coefficient different from the first correction coefficient in the first driving mode.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on the display signal to the modulation wiring in parallel in synchronization with the selection signal to drive the display device, the apparatus comprising:

a first driving mode that selects only one scanning wiring in one selection period;

a second driving mode that drivers the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period; and a control circuit that controls the image display apparatus so as to output, in the first driving mode, the modulation signal by use of a first correction coefficient corresponding to each display device and so as to output, in the second driving mode, the modulation signal based on a correction display signal computed newly every time by a correction computing unit according to the display signal and the first correction coefficient in the first driving mode so as to compensate for an error of luminance caused in the second driving mode.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and that applies a modulation signal based on the display signal to the modulation wiring in parallel in synchronization with the selection signal to drive the display device, the apparatus comprising:

a first driving mode that selects only one scanning wiring in one selection period;

a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period; and a control circuit that controls the image display apparatus so as to output, in the first driving mode, the modulation signal by use of a first correction coefficient corresponding to each display device and so as to output, in the second driving mode, the modulation signal based on a correction display signal computed by use of an average value of the first correction coefficients corresponding to display devices driven by a same modulation signal in selecting and driving a plurality of scanning wiring at the same time.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on the display signal to the modulation wiring in parallel in synchronization with the selection signal to drive the display device, the apparatus comprising:

a first driving mode that selects only one scanning wiring in one selection period;

a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period;

a memory that stores in advance a first correction coefficient corresponding to the first driving mode and a second correction coefficient corresponding to the second driving mode; and a control circuit that controls the image display apparatus so as to output the modulation signal based on a correction display signal computed by use of either of the first correction coefficient or the second correction coefficient according to each driving mode.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on the display signal to the modulation wiring in parallel in synchronization with the selection signal to drive the display device, wherein the apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period, and the apparatus comprises: a memory that stores in advance a first correction coefficient corresponding to each display device in a driving method for selecting the scanning wiring one by one without selecting and driving the plurality of scanning wiring at the same time; a correction computing unit that computes a correction display signal newly every time according to the display signal and the first correction efficient so as to compensate an error of luminance caused by selecting and driving the plurality of scanning wiring at the same time; and a control circuit that controls the image display apparatus so as to output the modulation signal based on the computed correction display signal.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on the display signal to the modulation wiring in parallel in synchronization with the selection signal to drive the display device, wherein the apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period, and the apparatus comprises: a memory that stores in advance a first correction coefficient corresponding to each display device in a driving method for selecting the scanning wiring one by one without selecting and driving the plurality of scanning wiring at the same time; a correction computing unit that computes a correction display signal by use of an average value of the first correction coefficients corresponding to display devices driven by a same modulation signal in selecting and driving the plurality of scanning wiring at the same time; and a control circuit that controls the image display apparatus so as to output the modulation signal based on the computed correction display signal.

According to still another aspect of the invention, there is provided an image display apparatus having a plurality of display devices; a plurality of scanning wiring and a plurality of modulation wiring connected to the plurality of display devices and arranged in a matrix; and a driving circuit that applies a selection signal to the scanning wiring selected in sequence and applies a modulation signal based on the display signal to the modulation wiring in parallel in synchronization with the selection signal to drive the display device, wherein the apparatus is driven so as to select, in one selection period, a plurality of scanning wiring at the same time and so as to select, in the following selection period, a plurality of scanning wiring a plurality of scanning wiring shifted by one scanning wiring from the plurality of scanning wiring selected in the preceding selection period, and the apparatus comprises: a memory that stores in advance a second correction coefficient constructed of an average value of first correction coefficients corresponding to display devices driven by a same modulation signal in selecting and driving the plurality of scanning wiring at the same time based on a first correction coefficient corresponding to each device in a driving method for selecting the scanning wiring one by one without selecting and driving the plurality of scanning wiring at the same time; and a control circuit that controls the image display apparatus so as to output the modulation signal based on the correction display signal corrected by use of the second correction coefficient.

According to still another aspect of the invention, there is provided a television apparatus comprising the image display apparatus according to any one of the above aspects and a receiving circuit that receives a television signal and supplies the image display apparatus with image data.

The invention can make an excellent correction to variations in the luminance of a display panel in an overlap scanning mode and can provide an image display apparatus having a bright screen and highly uniform luminance at low cost.

DETAILED DESCRIPTION OF THE PREFERRED EMBODIMENTS

Figure 1:
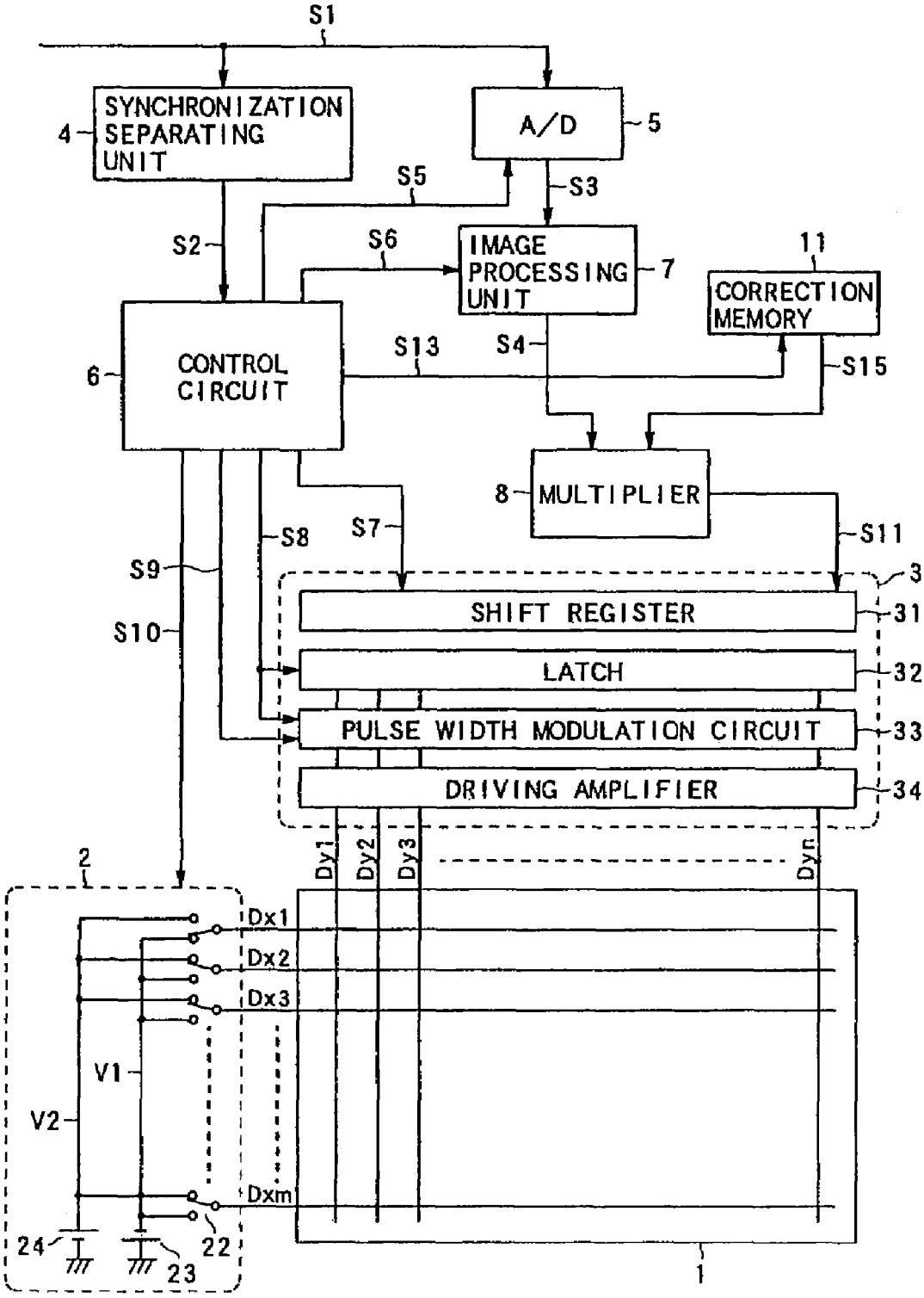
FIG. 1 PRIOR ART
FIG. 1 is a block diagram of a conventional image display apparatus.
Figure 2:
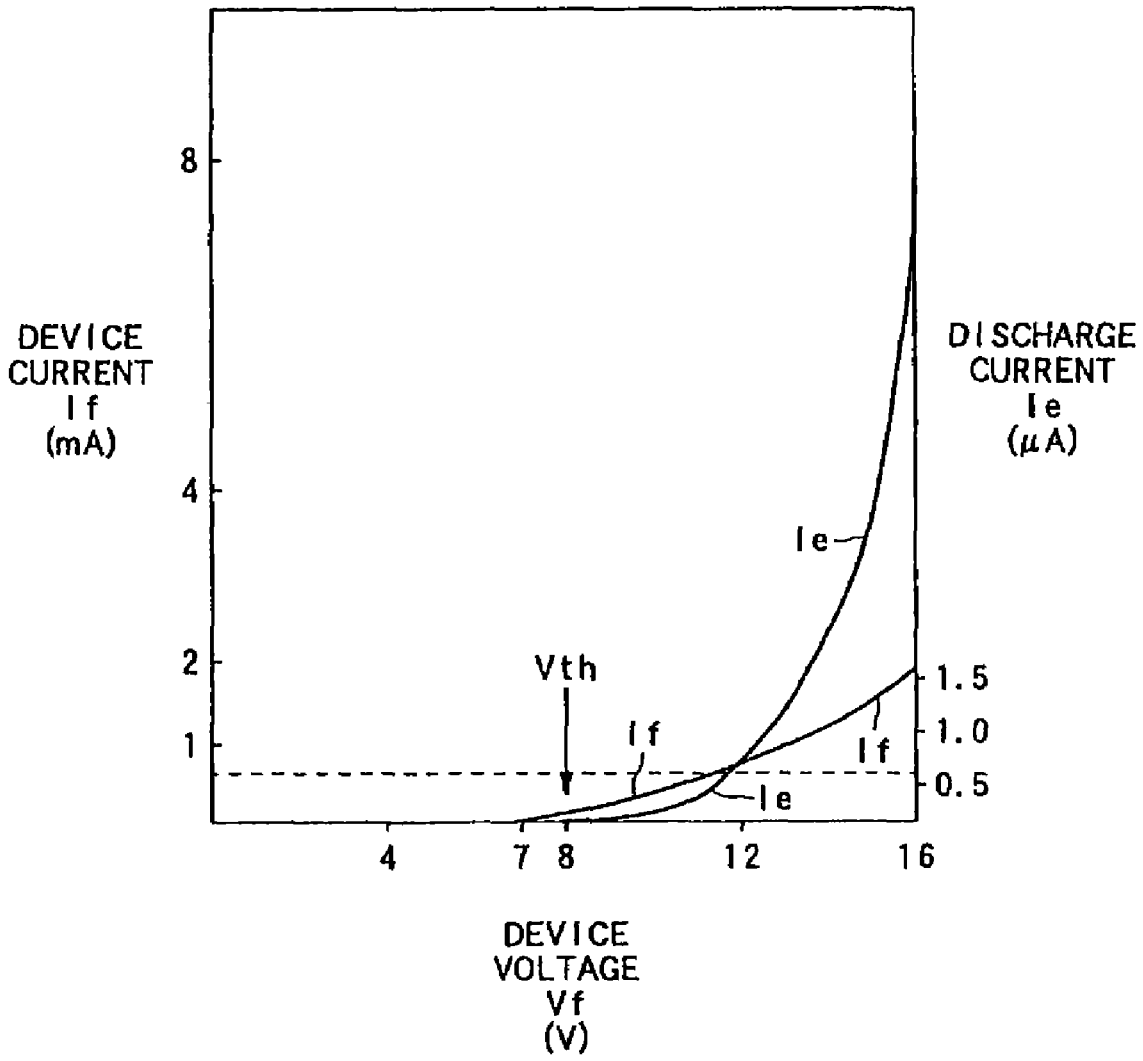
FIG. 2 PRIOR ART
FIG. 2 shows the characteristics of an electron emitting device.
Figure 3:
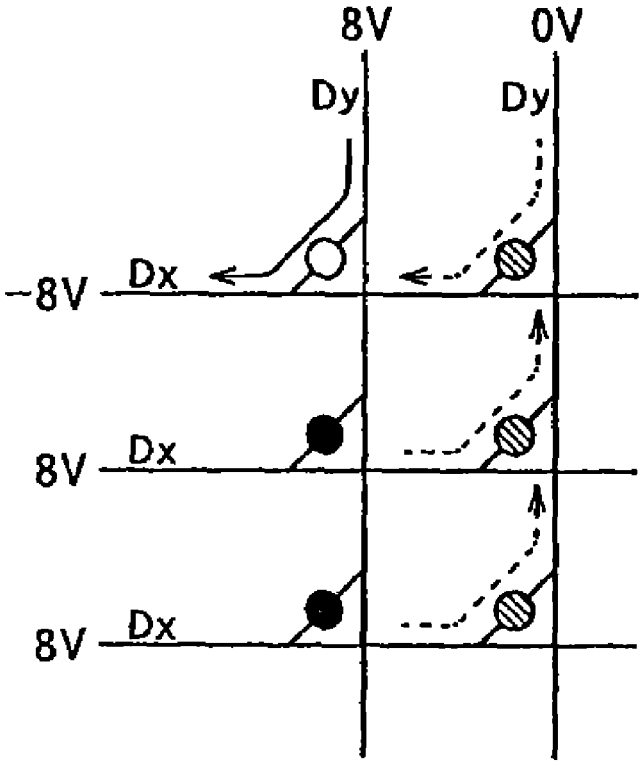
FIG. 3 PRIOR ART
FIG. 3 is a conceptual diagram of simple matrix driving.
Figure 4:
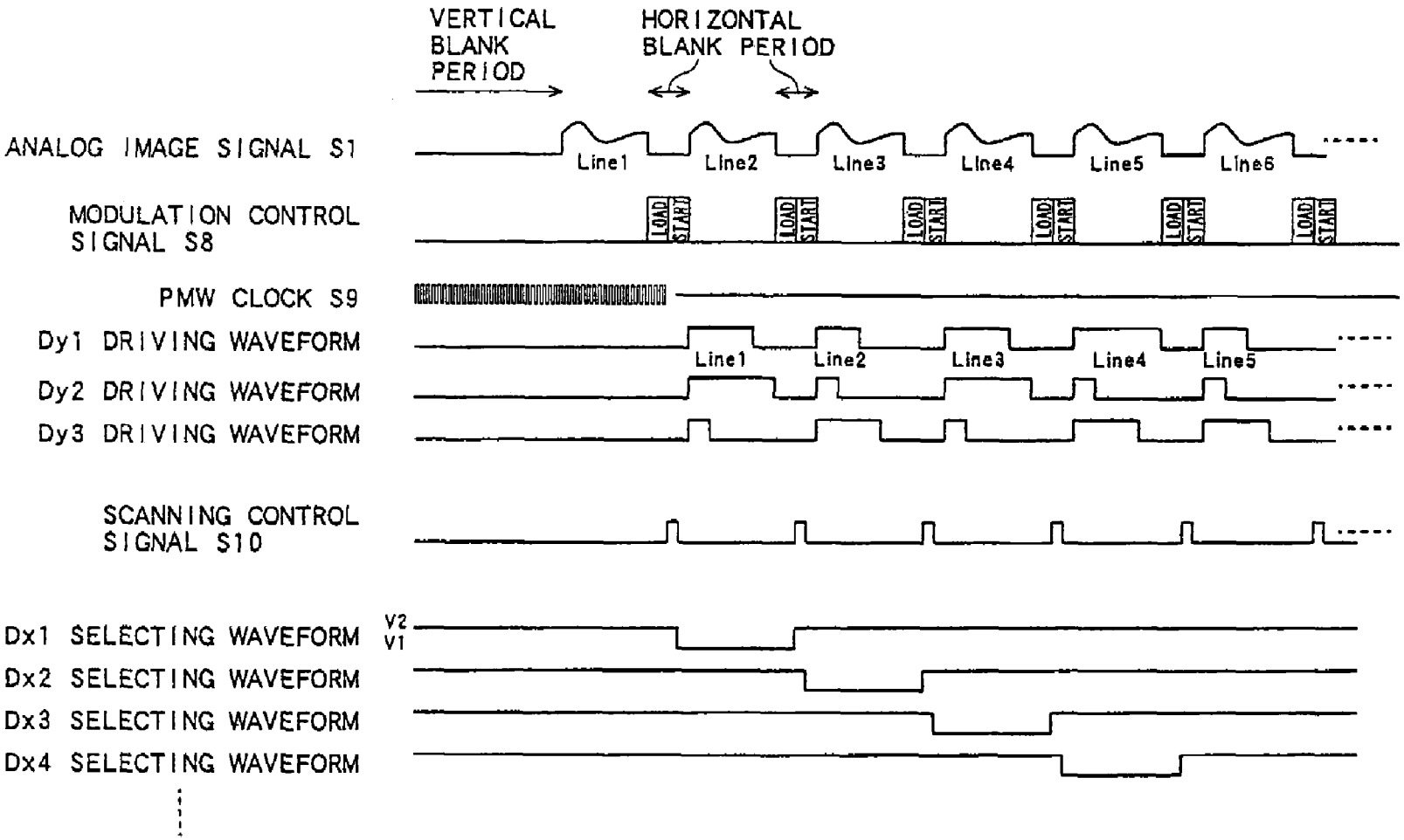
FIG. 4 PRIOR ART
FIG. 4 is a timing chart of conventional scanning.

Hereafter, preferred embodiments of the present invention will be described in detail by way of example by reference to the drawings. However, as to the sizes, materials, shapes, and relative arrangement of constituent parts described in this embodiments, it is not intended that the scope of this invention is limited only to these unless otherwise specified. Further, the matters described in BACKGROUND OF THE INVENTION are denoted by the same reference symbols and their descriptions will be not repeated.

Each scanning wiring Dxm is driven so as to be active between two continuous horizontal scanning periods and in such a way that two lines of neighboring scanning wiring are selected at the same time in each horizontal scanning period. As a result, the luminance of an image displayed on the display panel (image display apparatus) can be nearly doubled. This driving method is referred to as "overlap scanning mode". Further, if the overlap scanning mode is expressed widely conceptually, it can be said that the overlap scanning mode is a mode in which a plurality of scanning wiring are selected at the same time in one selection period and in which a plurality of scanning wiring shifted by one scanning wiring from the plurality of scanning wiring selected in the preceding selection period are selected in the following selection period.

Incidentally, a normal driving method for driving the display panel in such a way that one line of scanning wiring is selected in each horizontal scanning period is referred to as "normal scanning mode".

Such an overlap scanning mode can be realized in the same configuration as a normal image display apparatus and hence the display luminance of the image display apparatus can be greatly improved at low cost.

However, in the overlap scanning mode, two lines of scanning wiring are driven at the same time, so that it is impossible to correct variation in the luminance of two light-emitting devices by a correction coefficient Q(x, y) in the normal scanning mode as described in the paragraph of BACKGROUND OF THE INVENTION. The correction coefficient Q(x, y) is such that corrects variations in the luminance of the respective devices and is determined for each device. For this reason, even if a correction coefficient Q(x, y) for one device is used for another device, it is impossible to correct variations in luminance.

Hence, in the present invention, correction coefficients q(x, y), q'(x, y) for correcting variations in the luminance of two devices emitting light in one selection period are used in the overlap scanning mode to reduce variations in luminous efficiency. That is, the correction coefficients q(x, y), q'(x, y) are such that correct together variations in the luminance of two devices emitting light at the same time and are not determined for each device. The correction coefficients q(x, y), q'(x, y) compensate for error so as to make the actual luminance of two devices emitting light at the same time in the overlap scanning mode to desired luminance based on a display signal.

As to the switching between the normal scanning mode and the overlap scanning mode, for example, if an input image signal is such a kind of signal that does not need high luminance such as output image from a computer, a higher priority is given to resolution and hence the normal scanning mode is selected, whereas if an input image signal is such a kind of signal that is desired to have high luminance such as NTSC signal, a higher priority is given to luminance and hence the overlap scanning mode is selected.

Further, when a user requests to adjust brightness and depending on the kind of displayed content such as movie and graphic image, the mode can be switched between the normal scanning mode and the overlap scanning mode.

First Embodiment

Figure 5:
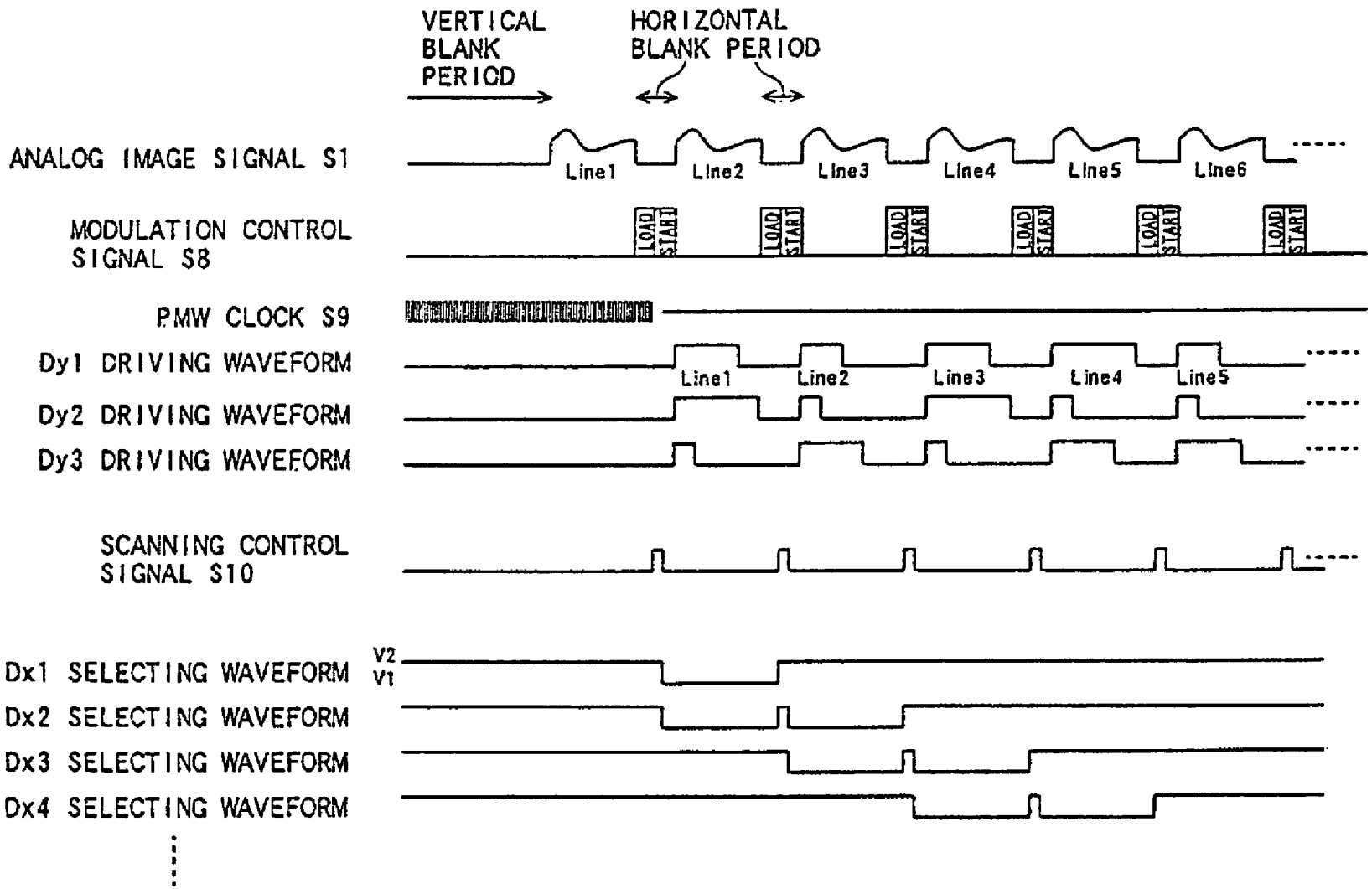
FIG. 5 is a timing chart of overlap scanning according to a first embodiment.

In the above-described overlap scanning mode, which is one application of a method for driving a display panel 1, the luminance of an image to be displayed on the display panel 1 can be increased by activating two or more lines of scanning wiring Dx1 to Dxm at the same time. Timing when the typical overlap scanning mode is used is shown in FIG. 5.

Figure 6:
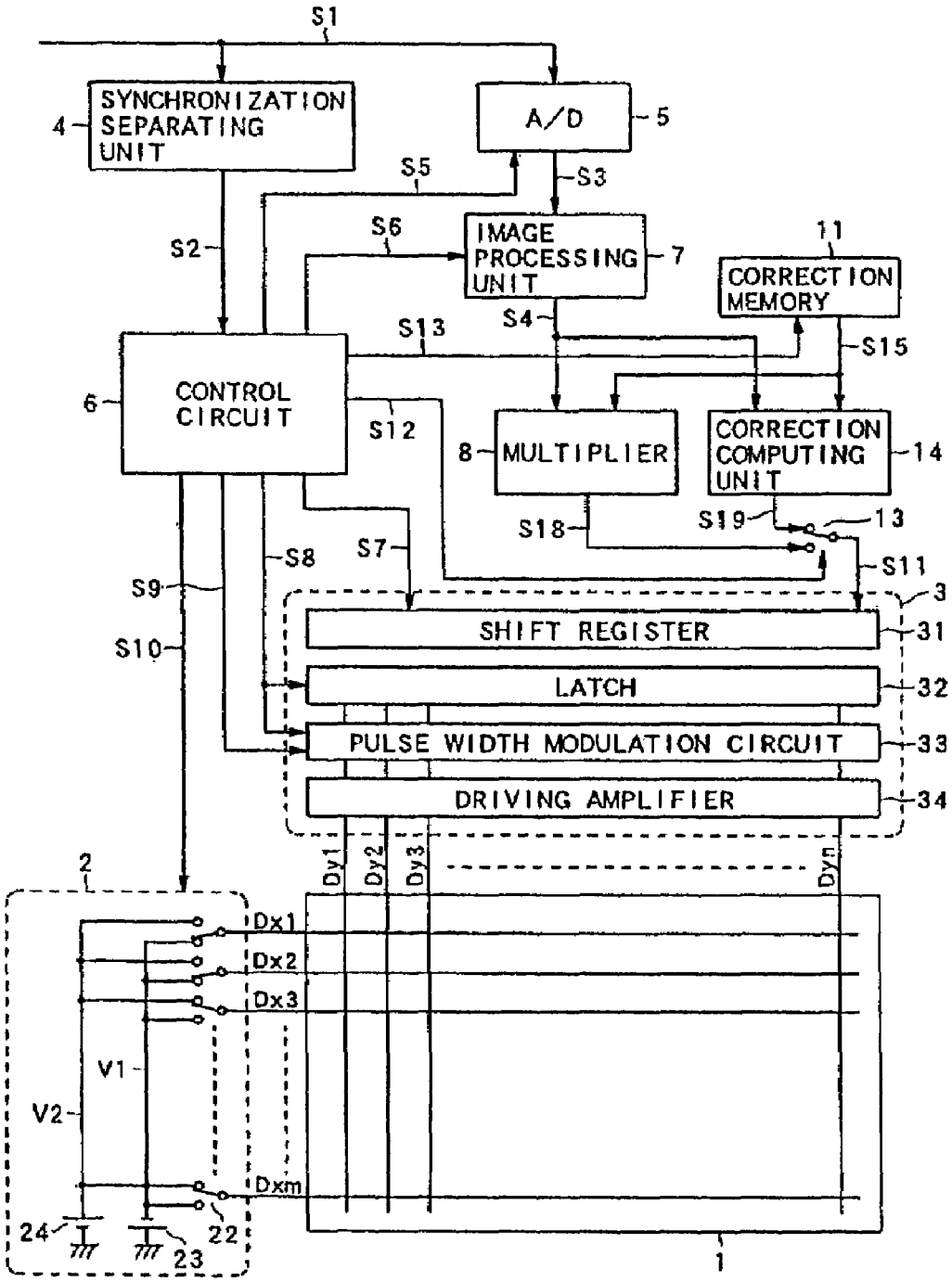
FIG. 6 is a block diagram of an image display apparatus according to the first embodiment.

FIG. 6 shows a configuration of an image display apparatus in a first embodiment. A reference numeral 14 denotes a correction computing unit for performing a correction computation in the overlap scanning mode. A reference numeral 13 denotes a selector switch for switching between a correction display signal S18 adapting to the normal scanning mode and a multiple correction display signal S19 adapting to the overlap scanning mode. The other configuration is the same as that of a conventional image display device shown in FIG. 1.

In the overlap scanning mode, a display device (x, y) corresponding to D(x, y) [$1 \leqq x \leqq n$ and $1 \leqq y \leqq m$] as a display signal S4 and a display device (x, y+1) of its neighboring directly lower scanning wiring are driven by D(x, y). Similarly, a display device (x, Y+1) and a display device (x, y+2) are driven by a display signal D(x, y+1).

That is, it is clear that the following equation holds:

$$V(x, y)=D(x, y-1)+D(x, y) \quad \text{[Equation 4]}$$

Since the pixel luminous efficiency of the device at a position (x, y) is K(x, y), each pixel emits light in the following amount of light emission:

$$P(x, y) \propto K(x, y) \times (D(x, y-1)+D(x, y)) \quad \text{[Equation 5]}$$

In order to correct this, it is recommendable to make the following equation hold by use of the correction coefficient Q(x, y) of the inverse of K(x, y):

$$V(x, y)=(D(x, y-1)+D(x, y)) \times Q(x, y) \quad \text{[Equation 6]}$$

Figure 7:
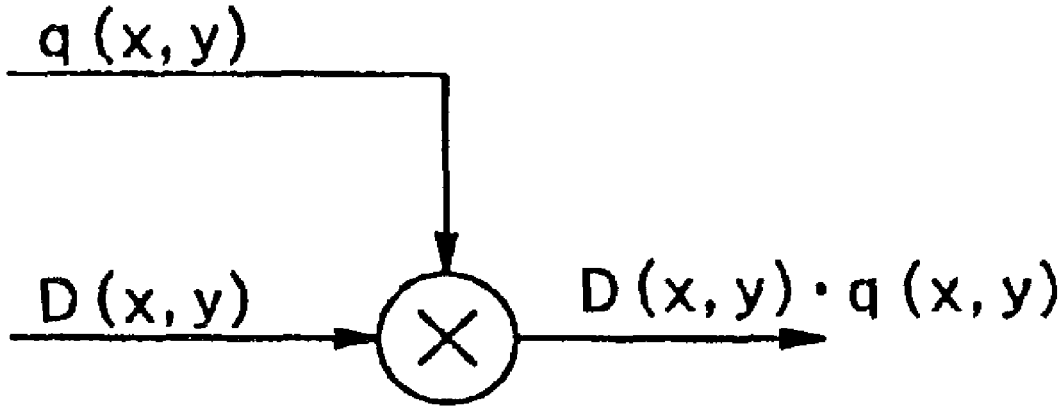
FIG. 7 shows an imaginary correction circuit according to the first embodiment.

On the assumption that a correction coefficient for an overlap scanning mode by a correction circuit shown in FIG. 7 exists, it is assumed that the correction coefficient is q(x, y). The device (x, y) and the device (x, y+1) are driven at the same time by D(x, y)×q(x, y) as the correction display signal S11. Similarly, the device (x, y+1) and the device (x, y+2) are driven by D(x, y+1)×q(x, y+1).

That is, the following equation holds:

$$V(x, y)=D(x, y-1) \times q(x, y-1)+D(x, y)) \times q(x, y) \quad \text{[Equation 7]}$$

Here, it is clear that by solving the following equation:

$$(D(x, y-1)+D(x, y)) \times Q(x, y)=D(x, y-1) \times q(x, y-1)+D(x, y) \times q(x, y) \quad \text{[Equation 8]}$$

by use of the equations 6 and 7, the correction coefficient q(x, y) for the overlap scanning mode can be determined.

Here, since a device (x, 0) is a device that is outside a display region and does not actually exist nor is driven, letting D(x, 0)=0, the following equation is obtained:

$$q(x, y)=Q(x, y) \ \{\text{where } y=1\}$$

$$q(x, y)=\{(D(x, y-1)+D(x, y)) \times Q(x, y)-D(x, y-1) \times q(x, y-1)\}/D(x, y) \ \{\text{where } 2 \leqq y \leqq m\} \quad \text{[Equation 9]}$$

As is clear from the equation 9, when the correction signal (correction coefficient q(x, y)) in the overlap scanning mode is computed, the display signal and the correction signal (correction coefficient q(x, y)) of the preceding line of scanning wiring are referred to. This means that the value of the correction signal (correction coefficient q(x, y)) varies, depending on an image to be displayed and that a predetermined fixed correction value (correction coefficient) can not be referred to by a table. That is, in the overlap scanning mode, a correction signal (correction coefficient q(x, y)) needs to be newly computed every time according to display contents and the correction signal (correction coefficient Q(x, y)) in the normal scanning mode.

By changing an equation of computing a correction signal (correction coefficient q(x, y)), an overlap correction display signal S19 is determined as follows:

$$D(x, y) \times q(x, y)=D(x, y) \times Q(x, y) \ \{\text{where } y=1\}$$

$$D(x, y) \times q(x, y)=(D(x, y-1)+D(x, y)) \times Q(x, y)-D(x, y-1) \times q(x, y-1)\}\{\text{where } 2 \leqq y \leqq m\} \quad \text{[Equation 10]}$$

Figure 8:
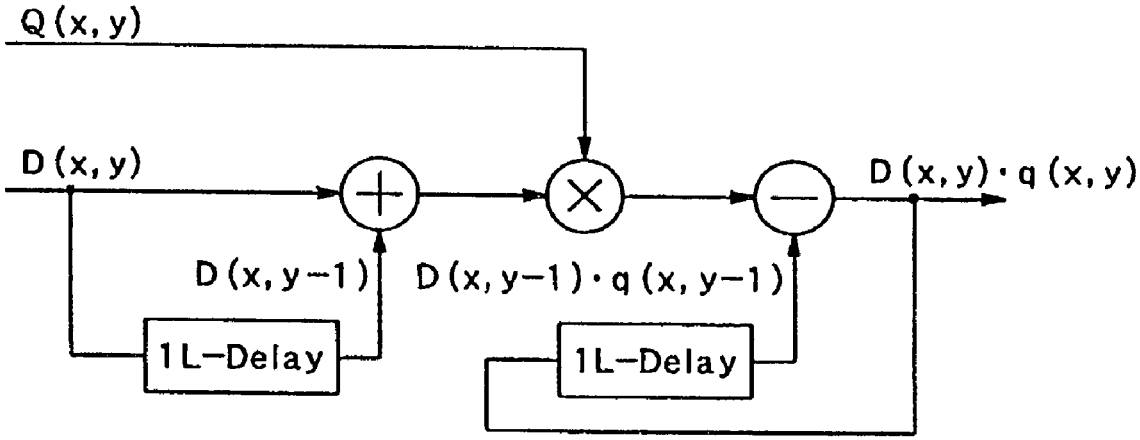
FIG. 8 shows an actual correction computing unit according to the first embodiment.

Hence, in an actual apparatus, a correction computing unit 14 can be realized by hardware constructed in the manner shown in FIG. 8.

[1L-Delay] in the drawing is a delay memory of one scanning line using FIFO or the like and, for example, if D(x, y) is input, D(x, y−1) is taken out.

A reference symbol S18 denotes a correction display-signal computed by the same method as used in the conventional apparatus shown in FIG. 1. A switching signal S12 is output from a control circuit 6 according to the normal scanning mode and the overlap scanning mode and, by controlling a selector switch 13, in the normal scanning mode, a display correction signal S18 adapting to the normal scanning mode is output as a correction display signal S11 and, in the overlap scanning mode, a display correction signal S19 corresponding to the overlap scanning mode is output as a correction display signal S11.

The other points are nearly the same as those of the conventional apparatus shown in FIG. 1. In this manner, a display apparatus capable of making an excellent correction to luminance in the overlap scanning mode can be realized.

Second Embodiment

It is also possible to produce an image display apparatus for making a correction in the overlap scanning mode at low cost by use of a simplified correction method.

Figure 9:
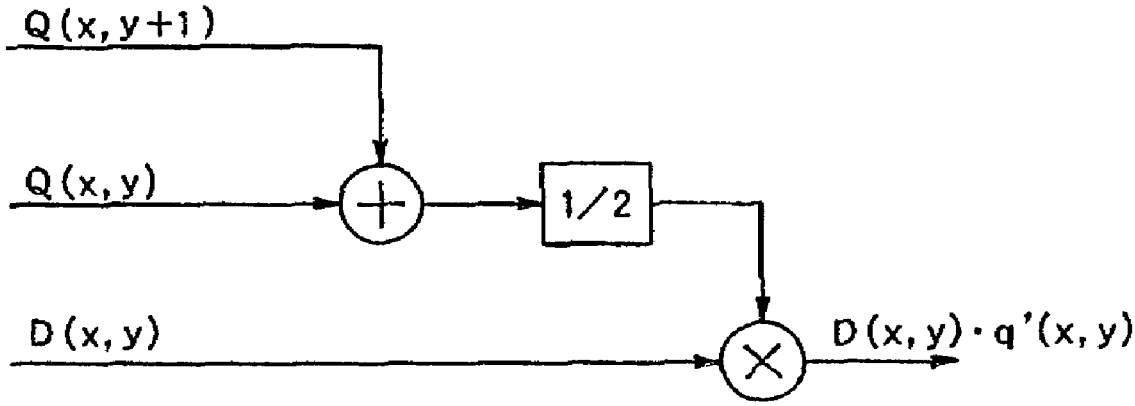
FIG. 9 shows an actual correction computing unit according to a second embodiment.

The configuration of a correction computing unit 14 in a second embodiment is shown in FIG. 9. In the image display apparatus of this configuration, the average of the inverse of luminous efficiency of a display device emitting light at the same time in the overlap scanning, that is, $$q'(x, y)=(Q(x, y)+Q(x, y+1))/2 \quad \text{[Equation 11]}$$

is used as a correction signal S15.

The other configuration and operation timing of the apparatus are nearly the same as those of the image display apparatus in the first embodiment shown in FIG. 6.

In this method, a vertical resolution of a correction signal is slightly degraded by the filtering effect caused by overlap scanning but an excellent correction can be still made to unevenness in the luminance of the whole screen.

This embodiment can be suitably used for a case where the cost of the apparatus is more important than the effect of correction and a case where the characteristic variation of adjacent devices is small and where importance is assigned to the correction of unevenness in the luminance of the whole screen.

Third Embodiment

In the image display apparatus of the simplified configuration shown in the second embodiment, it is also possible to store a correction signal corresponding to q'(x, y) in a table in advance.

Figure 10:
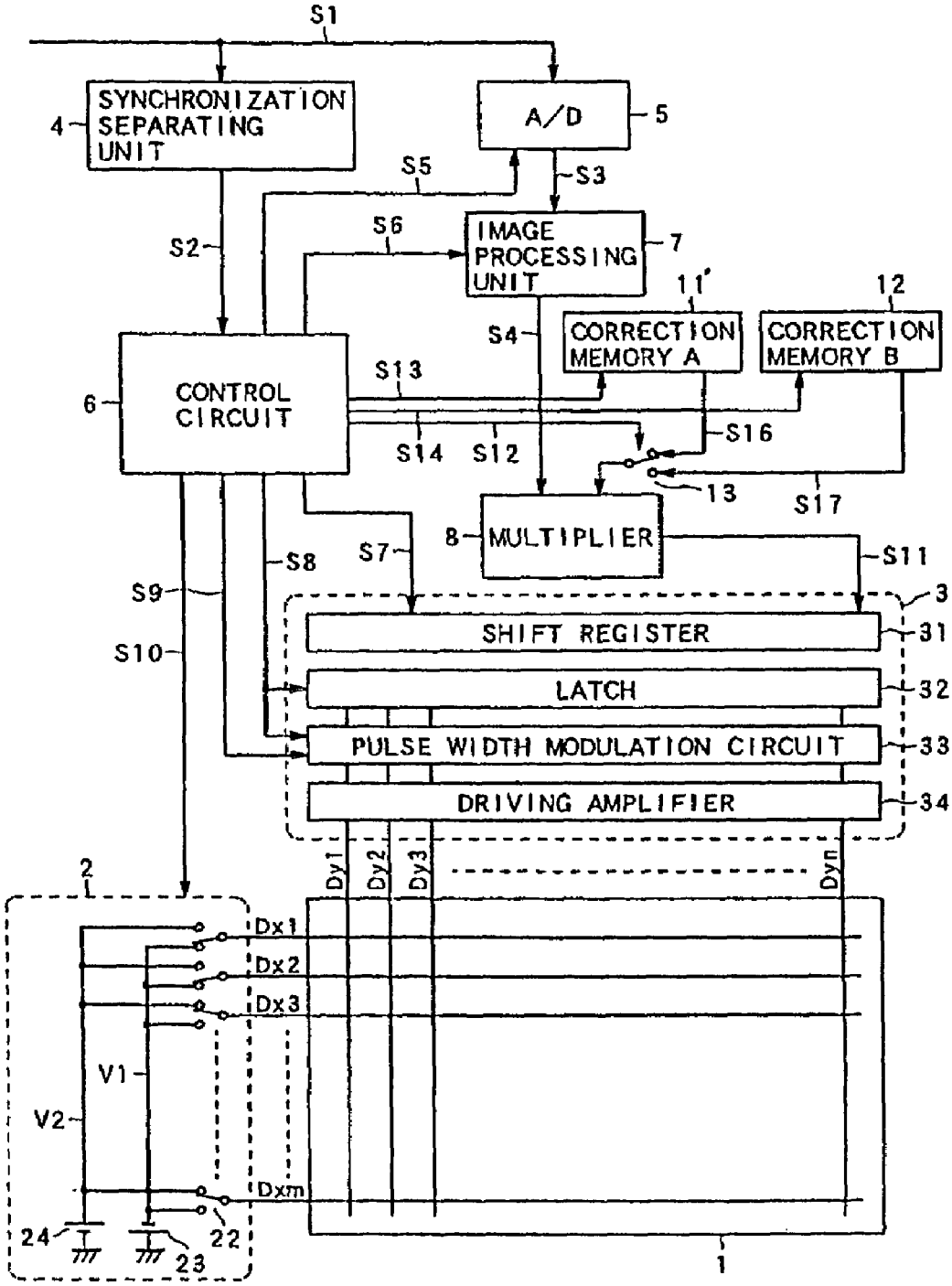
FIG. 10 is a block diagram of an image display apparatus according to a third embodiment.

The configuration of an image display apparatus in a third embodiment is shown in FIG. 10. A reference numeral 11' denotes a correction memory A for storing a correction coefficient Q(x, y) in the normal scanning mode. A reference numeral 12 denotes a correction memory B for storing a correction coefficient q'(x, y) in the overlap scanning mode. A reference numeral 13 denotes a selector switch for switching a correction signal according to the scanning mode.

In the normal scanning mode, the selector switch 13 selects a correction coefficient Q(x, y), which is a correction signal S16 of a correction value for the normal scanning mode, as a correction signal S15. In the overlap scanning mode, the selector switch 13 selects a correction coefficient q'(x, y), which is a correction signal S17 of a correction value for the overlap scanning mode, as a correction signal S15.

The other configuration and operation timing of this apparatus are nearly the same as those of the image display apparatus in the first embodiment shown in FIG. 6.

This embodiment as well as the second embodiment can be suitably used also for a case where the cost of the apparatus is more important than the effect of correction and a case where the characteristic variation of adjacent devices is small and where importance is assigned to the correction of unevenness in the luminance of the whole screen.

Fourth Embodiment

In an image display apparatus of the configuration shown in the first embodiment, an image display apparatus that is not driven in the normal scanning mode but is driven only in the overlap scanning mode can be realized.

Figure 11:
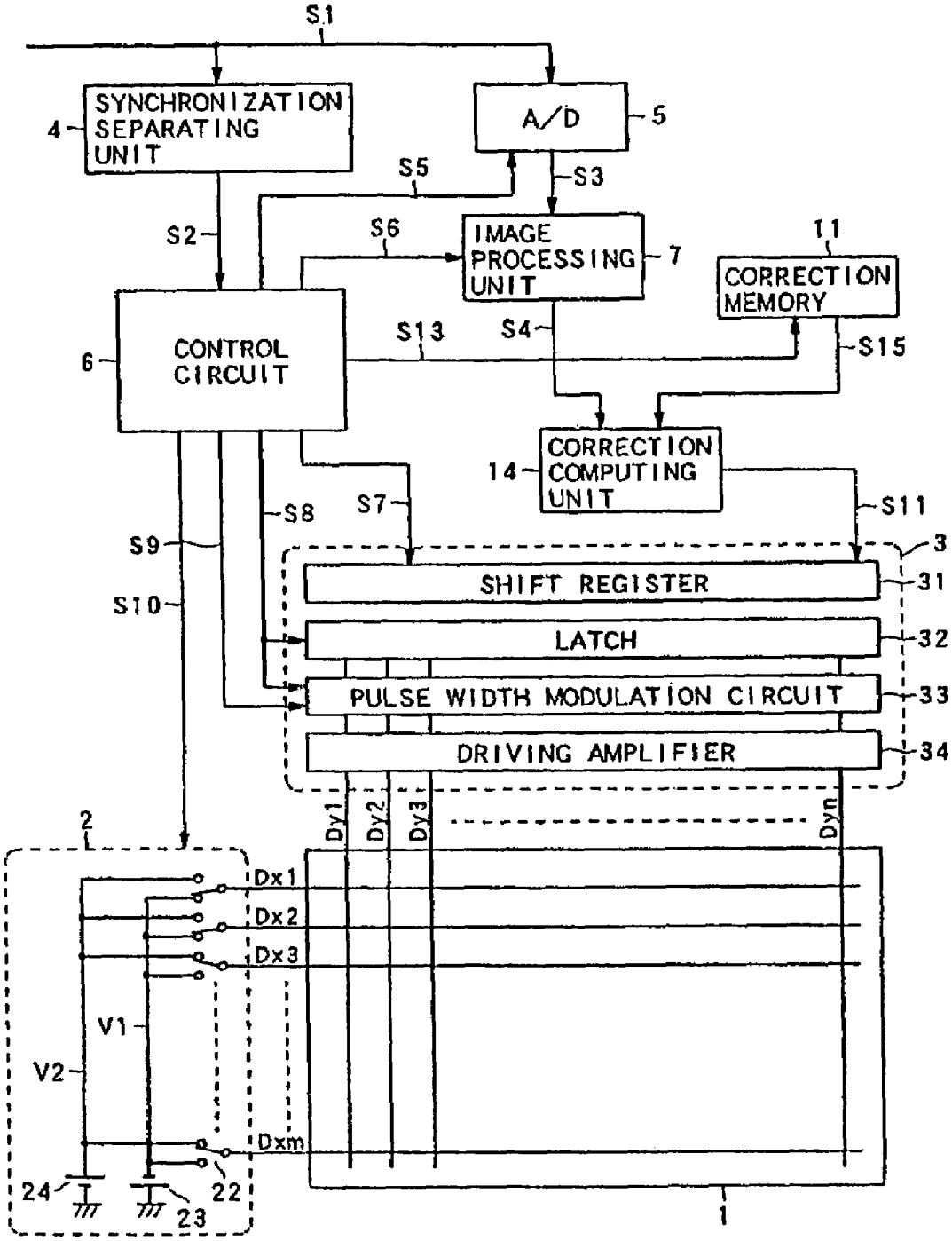
FIG. 11 is a block diagram of an image display apparatus according to a fourth embodiment.

The configuration of an image display apparatus in a fourth embodiment is shown in FIG. 11. A reference numeral 14 denotes a correction computing unit for performing a correction computation in the overlap scanning mode. In this embodiment, a multiplier 8 is not provided.

Since the display panel is driven only in the overlap scanning mode, a display correction signal S19 adapting to the overlap scanning mode is computed and output by the correction computing unit 14.

The other configuration and operation timing of this apparatus are nearly equal to those of the image display apparatus in the first embodiment shown in FIG. 6.

This embodiment can be suitably used for usage in which it is clear that the image display apparatus is driven only in the overlap scanning mode and to which a conventional image display apparatus is applied.

While this embodiment is a modification in which the image display apparatus in the first embodiment is driven only in the overlap scanning mode, similarly, it is also recommendable to construct the image display apparatus in the second embodiment and in the third embodiment so as to be driven only in the overlap scanning mode.

Embodiment of Television Apparatus

Figure 12:
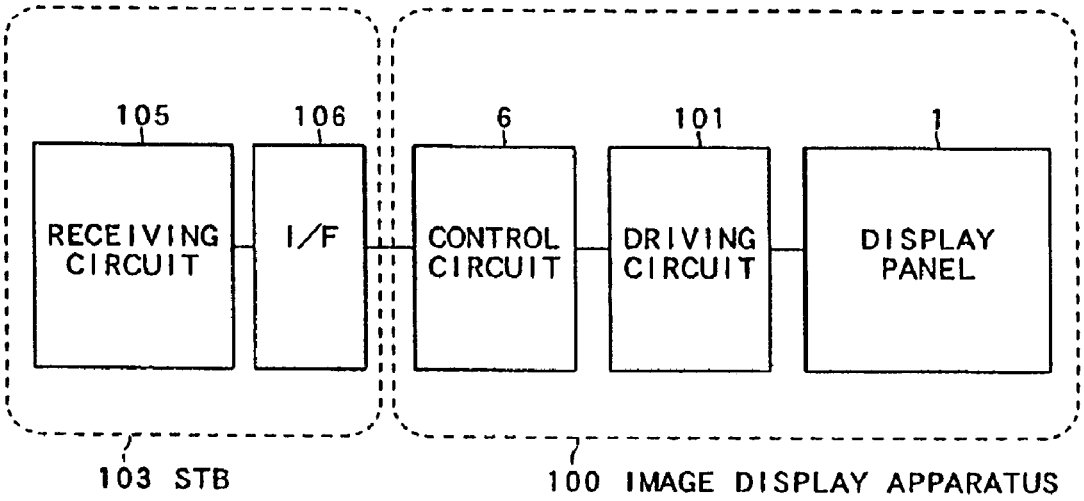
FIG. 12 is a block diagram of a television apparatus according to embodiment.

FIG. 12 is a block diagram of a television apparatus according to this embodiment. A receiving circuit 105 is constructed of a tuner, a decoder, and the like and receives a television signal of satellite broadcasting and terrestrial broadcasting, data broadcasting via a network, and the like, and outputs decoded image date to an I/F unit 104. The I/F unit 104 converts the image data into a display format of an image display apparatus 100 and outputs the image data to the image display apparatus 100. The image display apparatus 100 is constructed of a display panel 1, a driving circuit 101, and a control circuit 6. The control circuit 6 subjects the input image data to image processing suitable for the display panel 1 such as correction processing and the like, and outputs the image data and various kinds of control signals to the driving circuit 101. The driving circuit 101 includes a scanning driving unit 2, a modulation driving unit 3, and outputs a driving signal to the display panel 1 based on the input image data to display a television image.

Here, the receiving circuit 105 and the I/F unit 104 may be stored in a set top box (STB) 103, which is a box other than the image display apparatus 100, or may be in the same box as the image display apparatus 100.

This application claims priority from Japanese Patent Applications No. 2004-019679 filed Jan. 28, 2004, and No. 2004-019680 filed Jan. 28, 2004, which are hereby incorporated by reference herein.

What is claimed is:

1. A method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein the modulation signal is output in the first driving mode by use of a first correction coefficient corresponding to each display device, and the modulation signal is output in the second driving mode based on a correction display signal computed newly every time according to the display signal and the first correction coefficient in the first driving mode so as to compensate for an error of luminance caused in the second driving mode, wherein when it is assumed that the display signal for the display device located at a point of intersection (x, y) of an x-th wiring of a total of n modulation wirings and a y-th wiring of a total of m scanning wirings are D(x, y), and that the first correction coefficient corresponding to the first driving mode is Q(x, y), a second correction coefficient q(x, y) corresponding to the second driving mode is expressed by $$q(x, y)=Q(x,y) \ \{\text{where } y=1\}$$

$$q(x, y)=\{(D(x, y-1)+D(x, y))\times Q(x, y)-D(x, y-1)\times q(x, y-1)\}/D(x, y) \ \{\text{where } 2\leqq y\leqq m\}$$

and the correction display signal in the second driving mode is computed based on the second correction coefficient q(x, y).

2. A method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising:

a first driving mode that selects only one scanning wiring in one selection period; and a second driving mode that drives the image display apparatus so as to select, in one selection period, a plurality of scanning wiring at the same time and so as to select, in the following selection period, a plurality of scanning wiring shifted by one scanning wiring from the plurality of scanning wiring selected in the preceding selection period, and wherein the modulation signal is output in the first driving mode by use of a first correction coefficient corresponding to each display device, and the modulation signal is output in the second driving mode based on a correction display signal computed by use of an average value of the first correction coefficients corresponding to display devices driven by a same modulation signal in selecting and driving a plurality of scanning wiring at the same time, wherein when it is assumed that the display signal for the display device located at a point of intersection (x, y) of an x-th wiring of a total of n modulation wirings and a y-th wiring of a total of m scanning wirings are D(x, y) and that the first correction coefficient corresponding to the first driving mode is Q(x, y), a second correction coefficient q(x, y) corresponding to the second driving mode is expressed by $$q(x, y)=(Q(x, y)+Q(x, y+1))/2$$

and the correction display signal in the second driving mode is computed based on the second correction coefficient q(x, y).

3. A method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising a process for selecting and driving a plurality of scanning wiring at the same time, by which the image display apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period; and wherein a first correction coefficient corresponding to each display device in a driving method for selecting the scanning wiring one by one without using the process for selecting and driving a plurality of scanning wiring at the same time is stored in a memory in advance; and the modulation signal is output based on a correction display signal computed newly every time according to the display signal and the first correction coefficient so as to compensate for an error of luminance caused by using the process for selecting and driving a plurality of scanning wiring at the same time, wherein when it is assumed that the display signal for the display device located at a point of intersection (x, y) of an x-th wiring of a total of n modulation wirings and a y-th wiring of a total of m scanning wirings are D(x, y) and that the first correction coefficient corresponding to the first driving mode is Q(x, y), a second correction coefficient q(x, y) used for computing the correction display signal is determined as follows:

$$q(x, y)=Q(x, y)\{\text{where } y=1\}$$

$$q(x, y)=\{(D(x, y-1)+D(x, y))\times Q(x, y)-D(x, y-1)\times q(x, y-1)\}/D(x, y)\ \{\text{where } 2\leqq y\leqq m\}.$$

4. A method for driving an image display apparatus having a plurality of display devices and a plurality of scanning wiring and a plurality of modulation wiring connected to the plurality of display devices and arranged in a matrix, and in which a selection signal is applied to the scanning wiring selected in sequence, and a modulation signal based on the display signal is applied in parallel to the modulation wiring in synchronization with the selection signal to drive the display device, the method comprising a process for selecting and driving a plurality of scanning wiring at the same time, by which the image display apparatus is driven so as to select, in one selection period, a plurality of scanning wiring at the same time and so as to select, in the following selection period, a plurality of scanning wiring shifted by one scanning wiring from the plurality of scanning wiring selected in the preceding selection period; and wherein a first correction coefficient corresponding to each display device in a driving method for selecting the scanning wiring one by one without using the method for selecting and driving a plurality of scanning wiring at the same time is stored in a memory in advance; and the modulation signal is output based on a correction display signal computed by use of an average value of the first correction coefficients corresponding to the display devices driven by a same modulation signal in the process for selecting and driving a plurality of scanning wiring at the same time, wherein when it is assumed that the display signal for the display device located at a point of intersection (x, y) of an x-th wiring of a total of n modulation wirings and a y-th wiring of a total of m scanning wirings are D(x, y) and that the first correction coefficient corresponding to the first driving mode is Q(x, y), a second correction coefficient q(x, y) used for computing the correction display signal is determined as follows:

$$q(x, y)=((Q(x, y)+Q(x, y+1))/2.$$

* * * * *

UNITED STATES PATENT AND TRADEMARK OFFICE

CERTIFICATE OF CORRECTION

PATENT NO. : 7,375,733 B2
APPLICATION NO. : 11/039802
DATED : May 20, 2008
INVENTOR(S) : Muneki Ando It is certified that error appears in the above-identified patent and that said Letters Patent is hereby corrected as shown below:

COLUMN 1
Line 61, “is” should be deleted.

COLUMN 10
Line 8, “this” should read --these--.

COLUMN 12
Line 7, “can not” should read --cannot--.

Signed and Sealed this

Second Day of December, 2008

JON W. DUDAS
*Director of the United States Patent and Trademark Office*